United States Patent [19]

Tanaka et al.

[11] 4,163,360

[45] Aug. 7, 1979

[54] TIMER DEVICE

[75] Inventors: Kojiro Tanaka; Kazuhiro Yoda, both of Tokyo, Japan

[73] Assignee: Kabushiki Kaisha Daini Seikosha, Japan

[21] Appl. No.: 929,110

[22] Filed: Jul. 31, 1978

Related U.S. Application Data

[63] Continuation of Ser. No. 745,377, Nov. 26, 1976, abandoned.

[30] Foreign Application Priority Data

Nov. 27, 1975 [JP] Japan ..... 50-41921

[51] Int. Cl.[2] ..... G04C 21/00; G04C 21/34

[52] U.S. Cl. ..... 58/39.5; 58/38 R; 58/50 R; 58/57.5; 58/74; 58/145 D

[58] Field of Search ..... 58/23 R, 38 R, 39.5, 58/50 R, 57.5, 74, 145 R, 145 D

[56] References Cited

U.S. PATENT DOCUMENTS

| | | | |
|---|---|---|---|
| 3,662,535 | 5/1972 | Hedrick et al. | 58/39.5 |
| 3,899,892 | 8/1975 | Flumm et al. | 58/38 R X |
| 3,961,473 | 6/1976 | Hung | 58/145 D |
| 4,079,583 | 3/1978 | Larsen | 58/39.5 |
| 4,104,861 | 8/1978 | Yoda et al. | 58/38 R |

FOREIGN PATENT DOCUMENTS

| | | | |
|---|---|---|---|
| 2219114 | 10/1973 | Fed. Rep. of Germany | 58/39.5 |
| 2277605 | 2/1976 | France | 58/145 D |
| 493764 | 3/1976 | U.S.S.R. | 58/39.5 |

*Primary Examiner*—Stanley J. Witkowski

*Attorney, Agent, or Firm*—Burns, Robert E.; Emmanuel J. Lobato; Bruce L. Adams

[57] ABSTRACT

An event timer device having a plurality of memory counters each for memorizing the duration of a respective event. A selecting circuit selects one of the memory counters corresponding to a selected event having a predetermined duration for operating the selected memory counter to count down the memorized duration of the selected event. A display displays the remaining time of the selected event. The event counter further includes an alarm for generating an alarm signal at the end of the selected event.

5 Claims, 3 Drawing Figures

FIG. 1
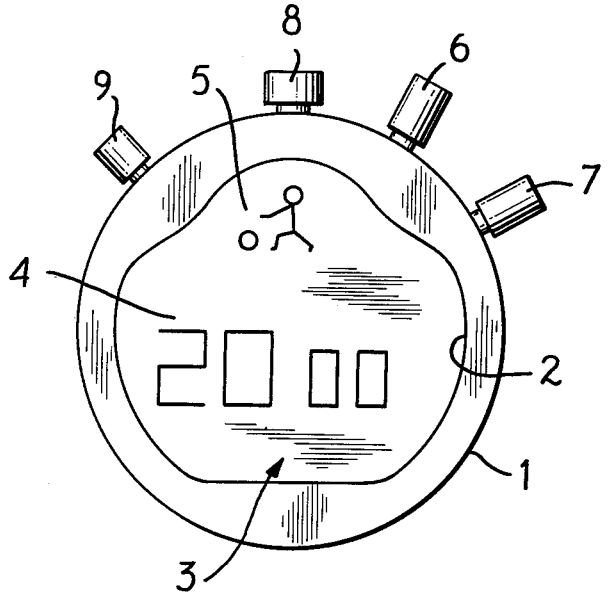
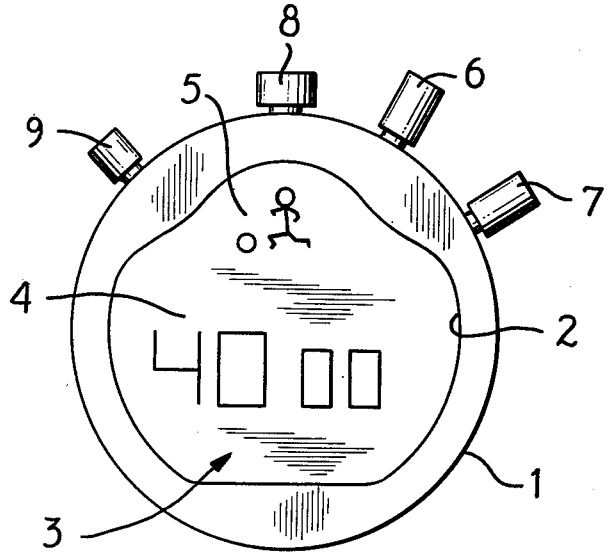
FIG. 2

TIMER DEVICE

This is a continuation of application Ser. No. 745,377, filed Nov. 26, 1976 and now abandoned.

BACKGROUND OF THE INVENTION

This invention relates to event timer device and more particularly to an event timer device for timing a selected one of a plurality of events having respective predetermined durations.

Conventionally, time display in an event timer device is by analogue display and the counted parameter is a passage of time of the event. Therefore it is very inconvenient to know the time or duration of each of the events which might be timed when their respective durations are different and it is especially difficult to know the remaining time of the event, and also it is very difficult to read out the time on an analog display.

SUMMARY OF THE INVENTION

Accordingly, the object of the present invention is to eliminate the above mentioned conventional disadvantages and provide an event timer device having a memory portion which memorizes a time according to the time or duration of each of the events which might be timed, and which displays the remaining time of the event digitally according to the time memorized in the memory portion.

Another object of the present invention is to provide an event timer device which emits an alarm when the remaining time is finished to inform that the first and latter halves of the event are over, and which displays marks corresponding to each of the events on the display portion to indicate the event which time is being counted.

BRIEF DESCRIPTION OF THE DRAWING

FIG. 1 is an external view showing an embodiment of an event timer device according to the present invention in case basketball is selected, FIG. 2 is an external view showing the embodiment in case association football is selected as well.

DESCRIPTION OF THE PREFERRED EMBODIMENT

Figure 3:
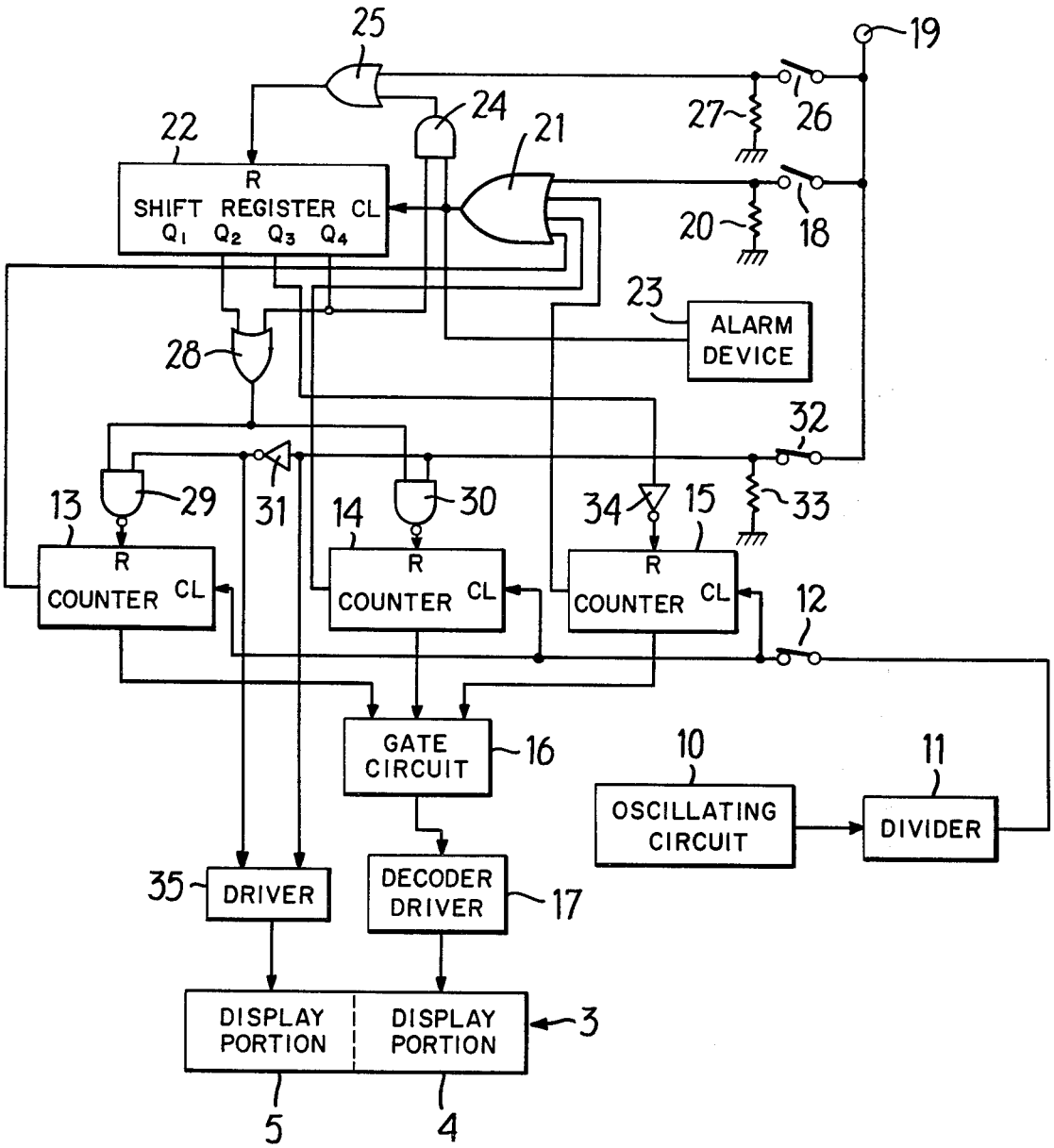
FIG. 3 is a circuit diagram showing an embodiment of an event timer device circuit according to the present invention.

FIG. 1 and FIG. 2 are external views of an embodiment of the event timer device according to the present invention, wherein a front surface of a case 1 is provided with an annular portion 2 defining an opening and in the case 1 is disposed a display device 3 opposite the opening defined by the annular portion 2. The display device 3 is made of a liquid crystal display element or a LED or the like, comprising a display portion 4 having four digits which displays time digitally and a display portion 5 which displays marks concerning the event. The case 1 mounts a push button 6 operated when time counting starts, a push button 7 operated when time counting stops, a switch change-over button 8 which selects the events for time counting, and a push button 9 operated when the ranking of the time of the event counted in turn is reset to zero as will be described later. The buttons 6–9 all can be manually operated. The present invention is an event timer device which is suitable for events such as basketball, association football, rugby or the like. The condition wherein basketball is selected is shown in FIG. 1 and that in which association football is selected is shown in FIG. 2. In FIG. 1, a mark which indicates basketball is visually shown in the display portion 5 and in FIG. 2, a mark which indicates association football is visually shown in the display portion 5.

Next, an event timer device shown in FIG. 1 and FIG. 2 will be described in detail in conjunction with the circuit diagram illustrated in FIG. 3.

In FIG. 3, numeral 10 is an oscillating circuit which includes a quartz vibrator or the like which generates a time counting reference signal. An oscillating signal of comparatively high frequency generated in the oscillating circuit 10 is divided into a signal having a period of one second, i.e. a second pulse is developed by the divider 11. In this invention, a second signal is fed through a switch 12 to clock terminal CL of three counters 13, 14, 15 which define a memory. The switch 12 is set between ON-OFF conditions by the push button 7 in FIG. 1 and FIG. 2, and ordinary set in the ON condition.

In this embodiment, the counters 13, 14, 15 comprising a memory portion are respectively provided with memory functions or capacities of 40 minutes, 20 minutes and 10 minutes, wherein the counter 13 is composed of a counter of 60 and 40 counting modes, the counter 14 is composed of a counter of 60 and 20 counting modes, and the counter 15 is composed of a counter of 60 and 10 counting modes. The above mentioned counters 13, 14, 15 are respectively down counters the counting outputs of which are displayed digitally on the display portion 4 of the display device 3 through a gate circuit 16 and a decoder driver 17. The counting contents of the 60 counting mode of the counters 13, 14, 15 designates a time unit of one second and the counting contents of the 40, 20 and 10 counting modes designate a time unit of one minute.

Numeral 18 is a switch operated by the push button 6 in FIG. 1 and FIG. 2 which normally is in the OFF condition and becomes ON whenever the push button 6 is pushed.

One contact of the switch 18 is connected with a voltage supply terminal 19 the electric potential of which corresponds to logic level "1", while the other contact of the switch 18 is grounded through a resistor 20 at a ground electric potential which corresponds to logic level "0" and also is connected with one of the input terminals of the OR circuit 21. The OR circuit 21 is provided with four input terminals, and to the rest of the three input terminals are fed borrow signals from the counters 13, 14, 15.

The output from the OR circuit 21 is fed to a clock terminal CL of a shift register 22 and also is fed to a control terminal of an alarm device 23, and further is fed to one input terminal of binary input AND circuit 24. The shift register 22 has a four counting mode, and the $Q_4$ output of the shift register 23 is fed to the other input terminal of the AND circuit 24 and also is fed to an OR circuit 28 together with $Q_2$ output. The output from the AND circuit 24 is fed to reset terminal R of the shift register 22 through binary input OR circuit 25. The shift register 22 responds to the reset pulse fed to the reset terminal R by the OR circuits 25 and the logic states of $Q_1$–$Q_4$ become "1, 0, 0, 0". The above mentioned alarm device 23 includes an alarm such as buzzer or the like responding to the output of the OR circuit 21 when it is at logic level "1".

To the other input terminal of the OR circuit 25 is connected a contact grounded through a resistance 27 of a switch 26 which has another contact connected to the voltage supply terminal 19. The switch 26 is controlled by the push button 9 in FIG. 1 and FIG. 2, which is normally in OFF condition and becomes ON when the push button 9 is pushed. When the switch 26 is ON-operated, the reset pulse of logic level "1" is produced from the OR circuit 25, whereby the shift register 22 is reset.

As mentioned above, $Q_2$, $Q_4$ outputs from the shift register 22 are fed to the OR circuit 28, and the output of the OR circuit 28 is fed respectively to input terminals of binary input NAND circuits 29, 30. Between the other input terminal of the NAND circuit 30 and the other input terminal of the NAND circuit 29 is connected an inverter 31. The input side of the inverter 31 is connected to a contact grounded through a resistance 33 of a switch 32 which has another contact connected to the voltage supply terminal 19. The switch 32 is switched between ON-OFF conditions by operation of the switch change-over button 8 in FIG. 1 and FIG. 2, which in this embodiment selects basketball in the ON-condition and selects association football in the OFF-condition. The logic signal from the switch 32 is applied to the input of the inverter 31 and the output of the inverter 31 is fed to the driver 35, and the output signal of the driver 35 is fed to the display portion of the display device 3. In case basketball is selected when switch 32 is switched ON, the input signal level of the inverter 31 becomes logic level "1" and a mark designating basketball is displayed on the display portion 5 by operation of the driver 35 as shown in FIG. 1. While in case association football is selected when switch 32 is switched off, the output signal level of the inverter 31 becomes logic level "1" and a mark designating association football is displayed on the display portion 5 as shown in FIG. 2.

The output of the NAND circuit 29 is fed to the reset terminal R of the counter 13 and the output of the NAND circuit 30 is fed to the reset terminal R of the counter 14. The $Q_3$ output of the shift register 22 is fed to the reset terminal R of the counter 15 through the inverter 34.

A description of the mode of operation of the event timer device according to the present invention follows.

When the switch 32 is switched on for time counting of basketball, a mark designating basketball is displayed on the display portion 5 as shown in FIG. 1. If the switch 18 is momentarily switched on when the event starts, a clock pulse is fed to the clock terminal CL of the shift resistor 22 through the OR circuit 21 and the $Q_2$ output of the shift resistor 22 becomes logic level "1". As the a result, both of the binary inputs of the NAND circuit 30 become logic level "1" and the output of the NAND circuit 30 become logic "0" and reset of the counter 14 is released. Accordingly, the counter 14 counts a second pulse fed to the clock terminal CL from the divider 11. The counter 14 is composed of a down counter of 60 and 20 counting modes. When the reset condition of the counter 14 is released, the display portion 4 displays a half time of basketball, 20:00 minutes through the gate circuit 16 and the decoder driver 17, and as the time passed by, the remaining time of the event is displayed in turn.

In case of time-out, the switch 12 is switched off and the clock pulse is stopped from being fed to the counter 14. Then when the event starts again the time is displayed on the display portion by switching ON the switch 12. When a half time of the basketball game i.e. 20 minutes which is memorized in the counter 14, elapses the borrow signal produced from the counter 14, is fed to the shift register 22 through the OR circuit 21 and $Q_3$ output from the shift resistor 22 becomes logic level "1". While at this time, the output from the OR circuit 21 is applied to the control terminal of the alarm generating circuit 23 and the alarm sounds to inform of the termination of the first half of the event. Simultaneous with the output $Q_3$ from the shift register 22 becomming logic level "1", the reset condition of the counter 15 which memorized a 10 minutes' interval of the basketball game is removed, and the counter 15 starts counting the second pulse, and then the counter 14 is reset. The counting content of the counter 15 is displayed digitally on the display 4, then and when the 10 minute interval is over, the borrow signal from the counter 15 is fed to the clock terminal CL of the shift register 22, and then the $Q_4$ output becomes logic level "1". By this, the counter 15 is reset and the reset condition of the counter 14 is removed. When the latter half of the event i.e. 20 minutes is over, the borrow signal from the counter 14 is fed to the shift register 22. Simultaneously, the output from the AND circuit 24 becomes logic level "1" and a reset pulse is fed to reset terminal R of the shift register 22 through the OR circuit 25. In response the $Q_1$ output of the shift resistor 22 becomes logic level "1" and time counting of the event is over. In case of stopping the time counting, the shift register 22 is reset at any time if the switch 26 is switched ON operated and to develop a reset signal and time counting is over.

In case of counting the event time when the event is association football, the switch 32 is switched OFF and association football is selected.

According to the present embodiment, the time event for association football is memorized as a 40 minute half time and a 10 minute interval, and the counter 13 and the counter 15 operate similarly as in the case of basketball by responding to the output from the shift register 22. While as shown in FIG. 2, a mark designating association football is displayed on the display portion 5.

As mentioned above, either basketball or association football is selected by operation of the switch 32 and the memorized time of the event is automatically counted. While the remaining time of the event is displayed on the display portion 4 and it is very convenient for the user. On the other hand, the on alarm is emitted by the alarm device 23 whenever the remaining time of the event is over. So that passage of time is remembered and the time of the event is suitably counted.

An event timer device according to the present invention has been described in conjunction with the shown embodiments. The present invention however is not limited to the shown embodiments and various modifications and changes are possible. For instance, though the shown embodiment is suitable for basketball and association football, it is possible to provide a device which can be used for other events or more than two types of events by alteration of the counting capacity of the counter circuits used as a memory or increasing the number of counter circuits or by increasing the number of bits of the shift resistor or alteration of the control system of the output.

As illustrated, an event timer device according to the present invention is provided with a memory portion which memorizes the time of the event for more than two kinds of events as well as a display which digitally displays the remaining time of the event. Therefore the predetermined event time can be counted without mistake and the remaining time necessary for the event can be read directly. Since the alarm device which emits an alarm sound when the remaining time is over is provided, there is no possibility that the passage of the time of the event is forgotten. Furthermore, as a mark designating the event which time is being counted is displayed on the display portion, it is possible to know which event is selected and counted and misselection is eliminated. Thus, as set forth herein, the present invention fully achieves the predetermined object and the practical efficiency is remarkable.

We claim:

1. An event timer device, comprising: a plurality of memory counters each for memorizing the duration of a respective one of a plurality of different events each having a respective different predetermined duration; selecting means for selecting one of said memory counters corresponding to a selected event and for operating the selected memory counter to count down the memorized duration of the selected event; time display means comprising a single display for displaying a remaining time of the selected event; and event display means cooperative with said selecting means for displaying which event is selected.

2. An event timer device according to claim 1; wherein said selecting means is comprised of a shift register circuit; means for applying a shift register output signal to a selected memory counter for enabling the same; and switching circuit means manually operable for shifting the content of said shift register circuit to control the output signal thereof and thereby control selection of said memory counters.

3. An event timer device according to claim 2; wherein said memory counters each have a reset terminal; and wherein said means for applying a shift register output signal is effective to apply reset signals to ones of said memory counters corresponding to non-selected events.

4. An event timer device according to claim 1; further comprising alarm means cooperative with said memory counters for generating an alarm signal at the end of the selected event.

5. An event timer device according to claim 1; wherein said display means is a digital display.

* * * * *